US005293018A

United States Patent [19]

Lander

[11] Patent Number: 5,293,018

[45] Date of Patent: Mar. 8, 1994

[54] ELECTRIC SWITCH

[75] Inventor: Hermann Lander, Villingen-Schwenningen, Fed. Rep. of Germany

[73] Assignee: Marquardt GmbH, Rietheim-Weilheim, Fed. Rep. of Germany

[21] Appl. No.: 930,352

[22] Filed: Aug. 17, 1992

[30] Foreign Application Priority Data

Aug. 29, 1991 [DE] Fed. Rep. of Germany ..... 4128714

[51] Int. Cl.[5] ..... H01H 21/24

[52] U.S. Cl. ..... 200/557; 200/558; 200/339

[58] Field of Search ..... 200/553, 554, 556, 557, 200/558, 562, 339, 517, 302.3, 512, 515, 511, 250, 290

[56] References Cited

U.S. PATENT DOCUMENTS 3,663,779 5/1972 Gerlach et al. ..... 200/302.2
4,045,650 8/1977 Nestor ..... 200/556
4,401,864 8/1983 Ichikawa ..... 200/339 X
4,710,602 12/1987 Baity et al. ..... 200/339 X

FOREIGN PATENT DOCUMENTS 7016357 9/1970 Fed. Rep. of Germany .
0235880 9/1987 Fed. Rep. of Germany .
3615059 11/1987 Fed. Rep. of Germany .
3719793 12/1988 Fed. Rep. of Germany ..... 200/556
3813350 11/1989 Fed. Rep. of Germany .
1094822 12/1967 United Kingdom .

*Primary Examiner*—Henry J. Recla
*Assistant Examiner*—Glenn T. Barrett
*Attorney, Agent, or Firm*—Spencer, Frank & Schneider

[57] ABSTRACT

An electric switch, and particularly a rocker switch, is proposed which is constructed as a monostable rocker switch. To achieve a resetting effect of the operating rocker (8) into the respective starting position, an elastic element (13) is provided between operating rocker (8) and switch housing (3), which becomes elastically deformed during the operation of the switch. After the load has been removed from the operating rocker (8), the elastic element (13) presses the operating rocker (8) back into its starting position.

9 Claims, 2 Drawing Sheets

ELECTRIC SWITCH

BACKGROUND OF THE INVENTION

The invention relates to an electric switch, particularly a rocker switch that has a rocking operating member supported in the upper part of a switch housing. The operating member has a switching pin that actuates an electric contact bridge. Between the operating member and the switch housing an at least partially elastically deformable element is disposed for urging the operating member into its starting position.

Electric switches, and particularly rocker switches, consist of a switch housing with an upper operating rocker, as is known, for example, from DE 36 15 059 A1 of the applicant. The operating rocker exhibits a downward pointing, rod-shaped switching pin which, when the rocker is operated, is connected directly or indirectly to a contact bridge or contact spring, arranged transversely in the switch housing, and presses it downward for establishing an electrical connection between, two connecting tabs. In this arrangement, the center bearing of the contact bridge itself can be constructed as an electrical connecting element to a connecting tab (DE 38 13 350 A1).

Instead of a rocker, the electric switch can also exhibit a toggle lever acting in the same way, as the operating member, as is shown, for example, in GB 1 094 822.

Such electric switches can be constructed to be bistable or monostable. In the case of a bistable switch, it dwells in two stable positions. A monostable switch always returns to its starting position. A bistable position is achieved, for example, by exceeding a deadpoint of a pretensioned spring element as is shown, for example, in DE 36 15 059 A1. In a monostable position, a corresponding spring element is arranged in such a manner that it cannot exceed a corresponding deadpoint.

SUMMARY OF THE INVENTION

The invention is based on the object of creating a monostable electric switch comprising a rocker-shaped or tippable operating member which provides a simple possibility for achieving the resetting effect.

This object and others to become apparent as the specification progresses, are accomplished by the invention, according to which, briefly stated, the electric switch includes a switch housing; a contact member movably supported in the switch housing; a rocking operating member tiltably supported in the switch housing and having a position of rest and an actuated position. The operating member further has a first part including a surface accessible exteriorly of the switch housing and being engageable for imparting an operating force thereon for moving the first part in a depressing direction; and a second part formed as an elongated switching pin extending from the first part into the switch housing and being operatively connected with the contact member for moving the contact member upon tilting motion of the operating member. The switching pin is movable in a compressing direction upon movement of the first part in the depressing direction. The depressing direction is generally perpendicular to the compressing direction. The switching pin has a side oriented towards an inner wall face of the switch housing and a distance between the side of the switching pin and the wall face of the switch housing is reduced upon motion of the operating member from the position of rest toward the actuated position. There is further provided an inherently elastically compressible element having opposite first and second surface portions and being disposed between the inner wall face of the switch housing and the side of the switching pin in the position of rest of the operating member. The first surface portion of the compressible element is in a face-to-face engagement with the side and the second surface portion of the compressible element is in a face-to-face engagement with the inner wall face of the switch housing and in the actuated position the compressible element is compressed in the compressing direction and exerts a resilient force on the side of the switching pin urging the operating member into the position of rest.

The electric switch according to the invention has the advantage that a monostable rocker switch or toggle switch is created, the tipping movement of which is designed to have controlled damping and the reset mechanism of which is achieved by the simplest means. According to the invention, an elastic element, that is to say an element similar to or like rubber, is provided for this purpose which becomes compressed, that is to say elastically deformed, when the operating member is operated and, after the load has been removed from the operating member, exerts a force on the latter in the sense of resetting. The elastic element is supported at a suitable point on the operating member and is pressed against the housing wall of the switch housing.

In addition to the aforementioned rubber-like elastic element, it is also provided that the elastic element is supported as a type of rubber buffer between the switching pin of the operating member and the switch housing wall. In this arrangement, the pot-shaped operating rocker can exhibit a correspondingly molded-in rubber element in its interior between the switching pin or a corresponding wall section and its outside wall. The lower L-shaped leg is laterally supported on the switch housing wall.

The elastic element can also be arranged as a rubber-like buffer in the switch housing itself or in its base, a leg projecting laterally in the upper area being supported against the operating member. The determining factor for the shape and the arrangement of the elastic element is its arrangement as a type of rubber buffer between the operating member and switch housing.

DESCRIPTION OF THE PREFERRED EMBODIMENTS

Figure 2:
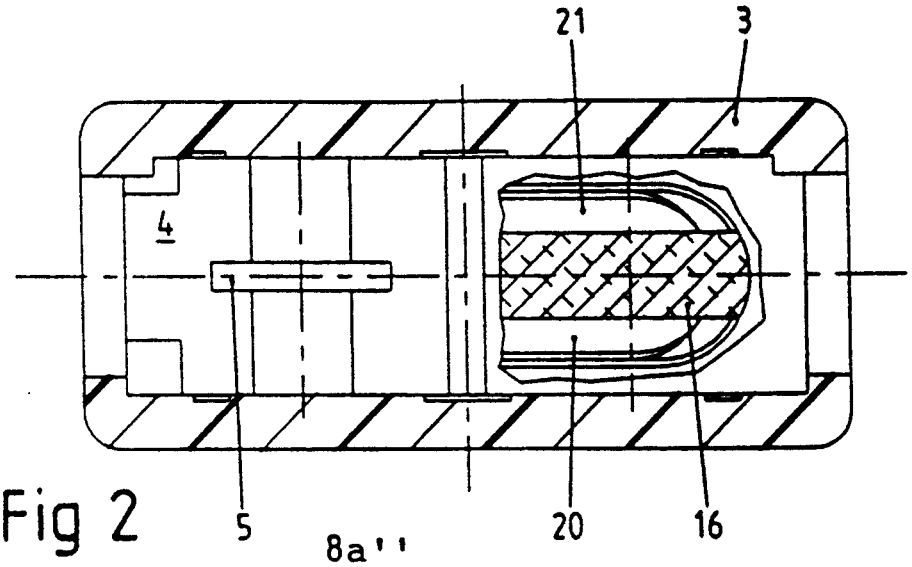
FIG. 2 shows a section along the section line II—II in FIG. 1 with some components omitted for the sake of simplicity and clarity.

The two electric switches 1, 2, shown in corresponding views in FIGS. 1 to 4, consist of a cross-sectionally rectangular switch housing 3 which is constructed to be pot-shaped and exhibits in its lower area a bottom plate 4 (see FIG. 3) into which the electric flat-pin contacts 5, 6 are inserted. The two flat-pin contacts 5, 6 are electrically connected via an electrically conductive contact bridge 7 as is shown, for example, in DE 38 13 350 A1. The flat-pin contact 5 is electrically connected to the center blade bearing 28 for the contact bridge 7 via a web 29.

The contact bridge 7 is operated via an operating member 8, which is constructed as an operating rocker 8 in the preferred embodiments. The operating rocker closes off the pot-shaped switch housing, which is open towards the top, in its upper, open area and is supported via two lateral bearing pins 9 in corresponding recesses 10 in the switch housing 3. The operating member 8 has a dish-shaped first part 8*a* having a cavity 8*a'* and an outer manually engageable surface 8*a''*. The operating rocker 8 has a second part constituted by a switching pin 11, protruding downward into the switch housing, the lower point (tip) 30 of which interacts with the contact bridge 7 as a switching element (see DE 38 13 350 A1). This switch-over process belongs to the prior art. Reference is made to the corresponding citations.

To establish a resetting effect or spring-back effect for forming a monostable electric rocker switch, an elastic element 12, 13 is provided according to the invention, which element is braced between a side 11*a* of the switching pin 11 and an inner wall face 3*a* of a switch housing wall 18. The side 11*a* and the surface 8*a''* are oriented approximately at 90° to one another. In the embodiment according to FIGS. 1, 2, this elastic element 12 is constructed to be L-shaped, with a vertical first leg 14, which is inserted into the pot-shaped rocker housing and is supported between the side wall 15 of the downwardly open pot-shaped rocker 8 and the switching pin 11 of the operating rocker 8. In the lower area, the elastic element 12 exhibits a second horizontal leg 16, the side area 17 of which is supported against the lateral inside wall face 3*a* of the switch housing 3. Naturally, the operating rocker can also exhibit in its interior an additional boundary wall 19 against which the vertical leg 14 of the elastic element 12 is supported. This wall 19 is only indicated by dashed lines.

Essentially, the elastic element 12 is intended to be deformed in the lower, horizontal leg 16. For this purpose, the vertical leg 14 of the elastic element 12 is also laterally bordered by one boundary wall 20, 21 each so that the operating rocker 8 is constructed to be a downwardly open pot-shaped housing which is closed at the top and on the side.

Figure 1:
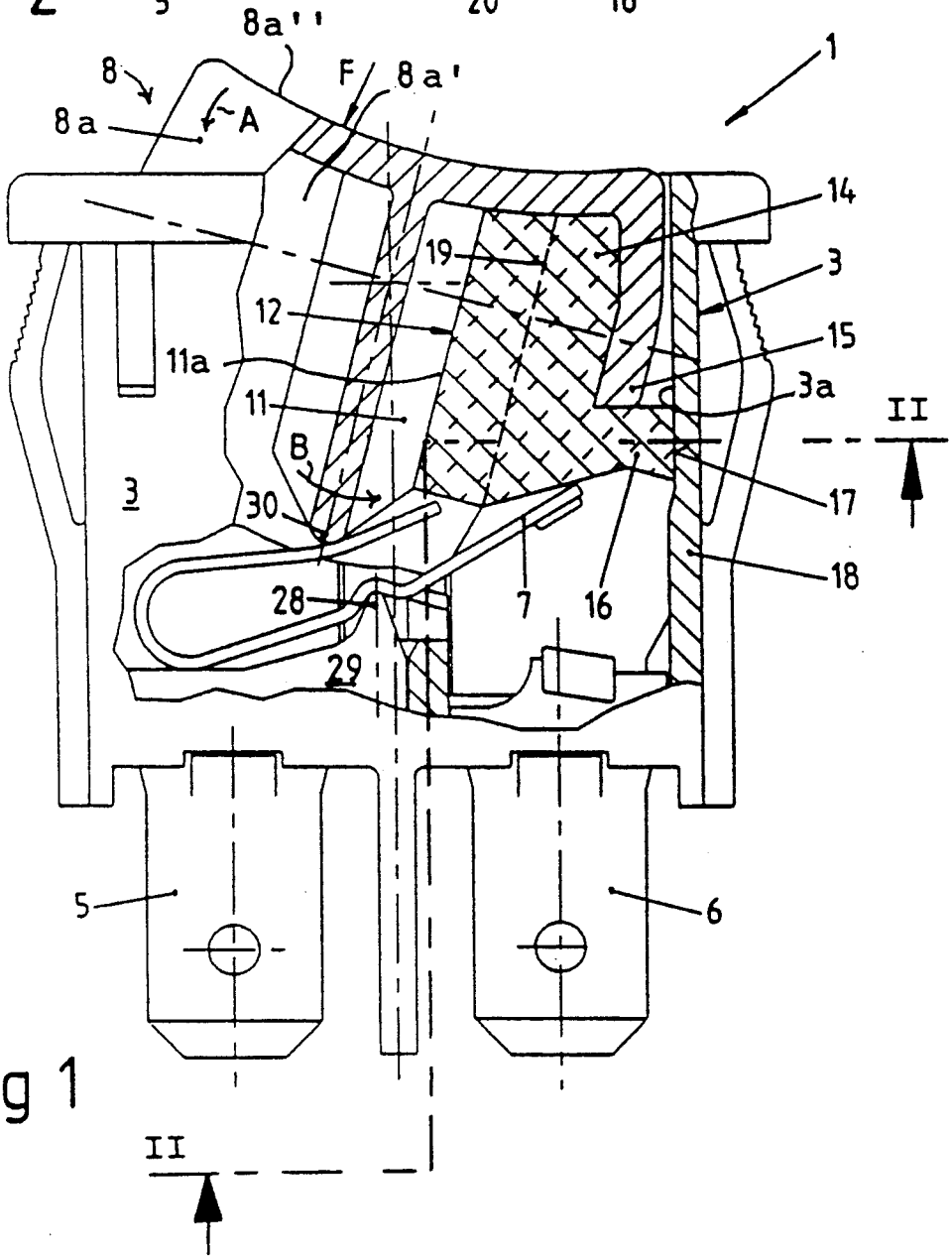
FIG. 1 shows a first preferred embodiment of a monostable rocker switch in a side view with the housing partially cut open.

When the operating rocker 8 is operated with the force F in its left-hand area shown in FIG. 1, the part 8*a* is displaced in the depressing direction A, while the switching pin 11 moves towards the inner wall 18, thus compressing the elastic element 12 in the direction B. The depressing direction A is generally perpendicular to the compressing direction B. The lower, horizontal leg 16 is pressed with its side area 17 against the inner wall face 3*a* and during this process becomes deformed. As soon as the operating force F disappears, the elastic reverse deformation of the elastic element 12 and, particularly, of the lower leg 16, produces a resetting effect which presses the operating rocker 8 back into its starting position. The switching behaviour of the switch is thus monostable.

Figure 3:
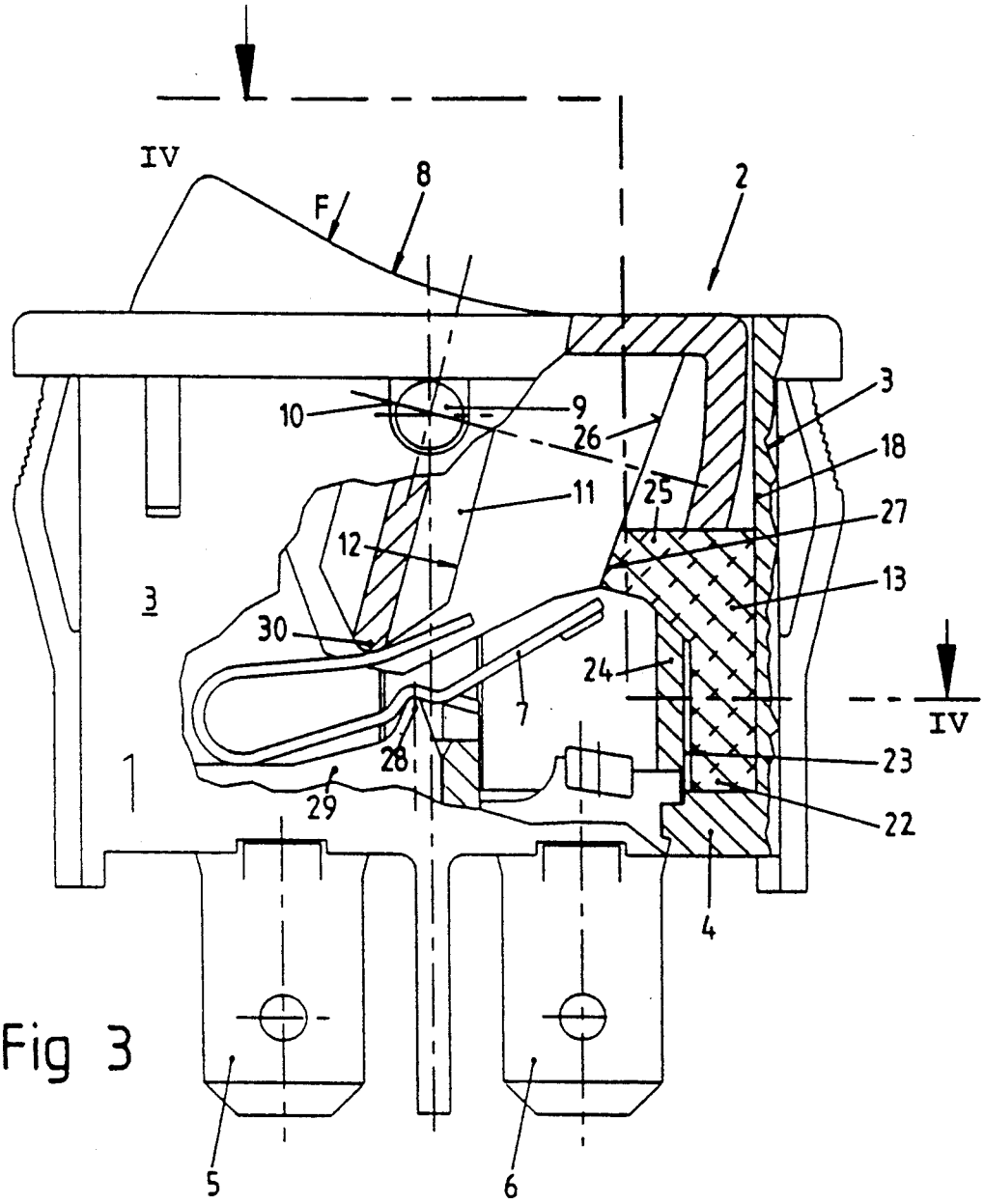
FIG. 3 shows a second variant of the embodiment of a monostable electric rocker switch in a side view with the housing partially cut open.
Figure 4:
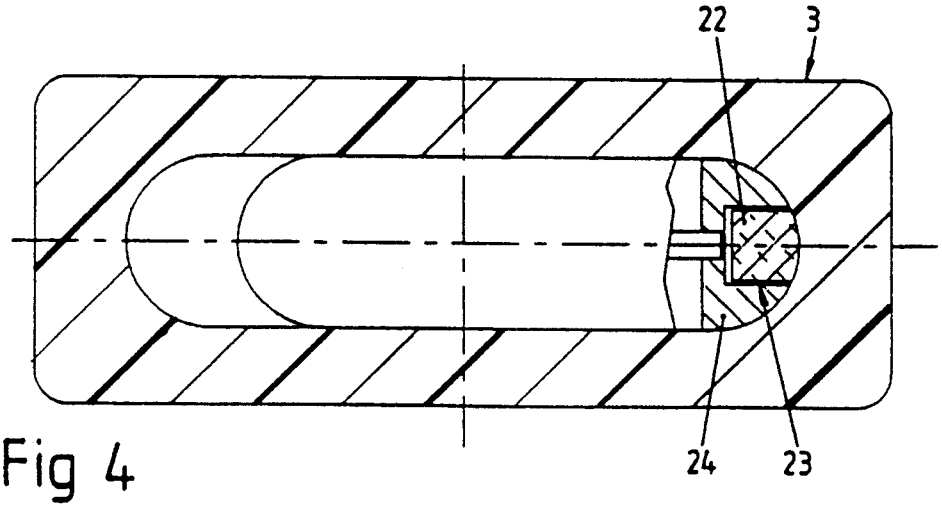
FIG. 4 shows a section along the section line IV—IV in FIG. 3 with some components omitted for the sake of simplicity and clarity.

In principle, the alternative switch arrangement of the invention according to FIGS. 3, 4 is of the same construction as the switch arrangement for FIGS. 1 and 2 with respect to the switching mechanism with respect to the operating member 8, contact bridge 7 and flat-pin contacts 5. The switch housing 3 also largely corresponds to the switch housing of FIGS. 1 and 2. Identical parts are therefore provided with identical reference symbols.

The elastic element 13 in the illustrative embodiment of FIGS. 3, 4 is also of L-shaped construction, the first vertical leg 22 being arranged not in the housing of the operating rocker 8, as in the illustrative embodiment of FIGS. 1, 2, but laterally in the switch housing 3 itself. For this purpose, a downwardly pointing pot-shaped recess 23 is provided on the inside wall 18 of the switch housing 3, into which the vertical leg 22 of the elastic element 13 is inserted to fix it in position. The inside wall of this retaining pocket is designated by 24.

The elastic element 13 has in its upper area a horizontal leg 25 which serves as a deformation element for the resetting effect of the operating rocker 8. For this purpose, the operating rocker 8 can exhibit an additional support wall 26 against which the inwardly pointing side area 27 of the horizontal leg 25 is supported. The supporting wall 26 extends largely parallel to the side edge of the switching pin and enables the leg 25 to be constructed shorter.

When the left-hand part of the operating rocker 8 in FIG. 3 is operated, the upper, horizontal leg 25 is again compressed by the supporting wall 26 and elastically deformed. When the load is taken off the operating rocker 8, the leg 25 again presses the supporting wall 26 in FIG. 3 to the left and returns the operating rocker 8 into the starting position. This arrangement is also constructed as a monostable switch.

Accordingly, the elastic element 12, 13 can be arranged with its holder part, that is to say its essentially vertical leg, both inside the operating rocker (FIGS. 1, 2) or inside the switch housing 3 (FIGS. 3, 4). The determining factor is the elastic deformation of the elastic element 12, 13, particularly in its horizontal leg 16, 25, which produces a resetting effect of the operating rocker 8.

The invention is not restricted to the illustrative embodiments shown and described. It also comprises all expert further developments and alternatives within the context of the concept according to the invention. In particular, the elastic element can also be arranged in a separate base 4 which, if necessary, can be inserted from below into the switch housing 3. Furthermore, the operating member itself can also be constructed as a tippable operating switch as is shown, for example, in GB 1 094 822 for operating the contact bridge. The determining factor is the elastic element, supported between the operating member and switch housing, as a resetting element. The elastic element can be constructed of an inherently elastically compressible material, such as rubber or rubber-like material (elastomer) and, if necessary, vulcanised into corresponding parts of the electric switch.

I claim:

1. An electric switch comprising (a) a switch housing having an inner wall face;

(b) a contact member movably supported in the switch housing and having first and second positions;

(c) a rocking operating member tiltably supported in said switch housing and having a position of rest and an actuated position; the operating member further having (1) a first part including a surface accessible exteriorly of said switch housing and being engageable for imparting an operating force thereon for moving said first part in a depressing direction; and (2) a second part formed as an elongated switching pin extending from said first part into said switch housing and being operatively connected with said contact member for moving said contact member upon tilting motion of said operating member; said switching pin being movable in a compressing direction upon movement of said first part in said depressing direction; said depressing direction being generally perpendicular to said compressing direction; said switching pin having a side oriented towards said inner wall face; a distance between said side of said switching pin and said wall face of said switch housing being reduced upon motion of said operating member from said position of rest toward said actuated position; and (d) an inherently elastically compressible element having opposite first and second surface portions and being disposed between said inner wall face and said side; in said position of rest of said operating member, said first surface portion of said compressible element being in a face-to-face engagement with said side and said second surface portion of said compressible element being in a face-to-face engagement with said inner wall face of said switch housing; in said actuated position said compressible element being compressed in said compressing direction and exerting a resilient force on the side of the switching pin urging said operating member into said position of rest.

2. The switch as defined in claim 1, wherein said surface of said first part of said operating member is oriented approximately at 90° to said side of said switching pin.

3. The switch as defined in claim 1, said switching pin having a tip remote from said first part of said operating member; said tip being in engagement with said contact member and being spaced from said compressible element.

4. The switch as defined in claim 1, wherein said first part of said operating member is a dish-shaped component defining a cavity; said compressible element has first and second legs together defining an L-shaped component; said first leg including said first surface portion and said second leg including said second surface portion; said first leg being received in said cavity and said second leg extending to said inner wall face of said switch housing.

5. The switch as defined in claim 1, wherein said compressible element is vulcanized to said side of said switching pin.

6. The switch as defined in claim 1, wherein said compressible element is vulcanized to said inner wall face of said switch housing.

7. The switch as defined in claim 1, wherein said switching pin includes two spaced, facing boundary walls extending substantially parallel to said side of said switching pin; said compressible element being partially received between said boundary walls.

8. The switch as defined in claim 1, wherein said switching pin includes a boundary wall extending generally parallel to said side of said switching pin; said first surface portion of said switching pin being supported by said boundary wall.

9. The switch as defined in claim 1, wherein said compressible element is braced between said side of said switching pin and said inner wall face of said switch housing.

* * * * *

UNITED STATES PATENT AND TRADEMARK OFFICE

CERTIFICATE OF CORRECTION

PATENT NO. : 5,293,018

DATED : March 8, 1994

INVENTOR(S) : Hermann Lander

It is certified that error appears in the above-indentified patent and that said Letters Patent is hereby corrected as shown below:

Column 6, after line 36, insert the following claim:

--10. The switch as defined in claim 1, wherein said switch housing comprises means for defining a recess; said compressible element having first and second legs together defining an L-shaped component; said first leg being received by said recess and said second leg extending to and being in a face-to-face engagement with said side of said switching pin.--.

on the title page, "9 Claims" should read -- 10 Claims--

Signed and Sealed this

Twenty-seventh Day of September, 1994

Bruce Lehman

*Attest:*

BRUCE LEHMAN

*Attesting Officer*

*Commissioner of Patents and Trademarks*